United States Patent [19]

Davis

[11] Patent Number: 4,928,328

[45] Date of Patent: May 29, 1990

[54] COMMODE AND REMOVABLE SEAT

[76] Inventor: John W. Davis, Rt. 2, Box F, Rayville, La. 71269

[21] Appl. No.: 231,908

[22] Filed: Aug. 15, 1988

Related U.S. Application Data

[63] Continuation-in-part of Ser. No. 940,741, Dec. 11, 1986, abandoned.

[51] Int. Cl.[5] ..... E03D 11/02

[52] U.S. Cl. ..... 4/420; 4/237

[58] Field of Search ..... 4/237, 239, 242, 254, 4/420, 480, 300.3, DIG. 5; 297/DIG. 4; 280/242 W C; 410/7

[56] References Cited

U.S. PATENT DOCUMENTS 331,993 12/1885 Moore ..... 4/DIG. 5 X 612,076 10/1898 Weston ..... 4/DIG. 5 X

*Primary Examiner*—Charles E. Phillips

*Attorney, Agent, or Firm*—John M. Harrison

[57] ABSTRACT

A specially designed commode which is configured to receive a latching device for securing a wheelchair to the commode and is characterized by an elongated bowl provided with a U-shaped rim and a corresponding removable and reversible seat. The removable seat is provided with a curved, downwardly-extending splash shield which extends inside the rim and a front flange, in order to stabilize the seat on the commode rim, facilitate removal of the commode seat from the commode rim and prevent contamination of the rim by splashing. The rim is hollow and is designed to receive water from a cooperating water tank and flush chamber for flushing the commode and the commode bowl further defines a base that is bolted to the floor in conventional fashion.

2 Claims, 2 Drawing Sheets

COMMODE AND REMOVABLE SEAT

BACKGROUND OF THE INVENTION

Cross-Reference to Related Applications

This application is a Continuation-In-Part of my copending U.S. patent application Ser. No. 06/940,741, filed Dec. 11, 1986, entitled "Commode", which is copending with my U.S. patent application Ser. No. 07/083,067, filed Aug. 10, 1987, entitled "Chair Bed" both now abandoned.

Field of the Invention

This invention relates to a specially designed commode for receiving a wheelchair latching device such as the "Wheelchair Latching Device" disclosed in my copending U.S. patent application and attaching a wheelchair or chair bed such as the "Chair Bed" disclosed in my copending U.S. patent application, to the commode. More particularly, the invention relates to a specially designed commode which is characterized by an elongated bowl with a U-shaped rim provided thereon and a correspondingly-shaped, removable and reversible commode seat fitted to the rim by means of a spalsh shield and a front seating flange. In a preferred embodiment, the rim is hollow and receives water from a flush chamber connected to the rim, in order to flush the commode.

One of the problems realized in the case of invalids who are confined to wheelchairs is that of exiting the wheelchair, maneuvering onto a conventional commode and subsequently relocating in the wheelchair. The problem is intensified because conventional commodes are neither designed to receive a wheelchair nor to accommodate an invalid who moves from the wheelchair to the commode and back again. This maneuver is frequently difficult or impossible in the case of invalids who are not ambulatory and have limited strength and these persons must generally be helped from the wheelchair onto the commode and back into the wheelchair. Although conventional wheelchairs are provided with wheel locks to prevent the wheelchair from rolling, the wheelchair may still slide with respect to the commode, thereby causing injury to the occupant. This hazard is particularly apparent under circumstances where the bathroom floor is constructed of tile or is waxed and the commode is of an older design, wherein the bowl is small and substantially round.

Another problem is contamination of conventional commode seats by splashing, particularly when the commode is used by persons having infectious diseases.

DESCRIPTION OF THE PRIOR ART

Conventional commodes are designed with little or not thought relative to use by invalids who are confined to wheelchairs. The various commode designs are povided primarily to satisfy the needs of ambulatory persons and are generally either oval or round in design, with a hinged toilet seat. Even the new commode designs which feature side bars and other assist devices to help wheelchair-bound persons move from the wheelchair to the commode and back, are not designed to accommodate people who are wheelchair-bound and frequently do not have sufficient strength to move from the wheelchair to the commode and back to the wheelchair without the assistance of others. Furthermore, these commode designs do not facilitate examination of a wheelchair-bound person by a doctor or nurse under certain testing conditions where expulsion of body waste is required. Such procedures, including lower gastrointestinal testing procedures, normally require that a person be moved from an X-ray table to a conventional bathroom and back again during the testing period. This required ambulation is especially burdensome to persons who are confined to a wheelchair. Conventional commode seats are hinged to the commode bowl or rim and are difficult to clean and sanitize, particularly under circumstances where the commode is used for diagnostic tests, such as lower gastrointestinal procedures. Accordingly, it is an object of this invention to provide a specially designed commode which is provided with a removable commode seat and is designed to accommodate wheelchair-bound persons.

Another object of the invention is to provide a new and improved commode which is designed to facilitate movement of an ambulatory person from a wheelchair to the commode and back again with minimum effort and maximum utility.

Still another object of the invention is to provide a new and improved, elongated commode which is provided with a removable and disposable commode seat and is designed to receive a wheelchair, in order to facilitate movement of a non-ambulatory person from the wheelchair to the commode and back, with optimum facility.

Yet another object of this invention is to provide a new and improved commode which is designed to receive a specially designed latching mechanism for locking a wheelchair in close proximity to the commode, which commode is provided with a removable and reversible seat for optimum sanitation and is elongated in design, in order to facilitate maneuvering a wheelchair-bound patient from the wheelchair to the commode and back to the wheelchair.

Still another object of the invention is to provide a new and improved, elongated commode fitted with a wheelchair mechanism for locking a wheelchair in close proximity to the commode and a removable, reversible and disposable commode seat having a downwardly-extending splash shield or interior flange and a front exterior flange for removably securing the seat to the commode rim and protecting the rim from splashing.

A still further object of this invention is to provide a new and improved, elongated commode which is designed to receive a wheelchair mechanism for locking a wheelchair into close proximity to the commode and includes a removable, reversible and disposable commode seat having a curved, downwardly-extending splash shield for mounting on the inside of the rim of the commode and a front seating flange engaging the outside of the commode rim, in order to accommodate a wheelchair-bound patient for examination purposes.

SUMMARY OF THE INVENTION

These and other objects of the invention are provided in a new and improved commode which is characterized by a generally elongated bowl and curved rim and a removable, reversible and disposable, U-shaped seat removably carried by the rim, including a latching mechanism mounted to the floor in front of the commode, for attaching a wheelchair in close proximity to the commode and facilitating movement of a non-ambulatory person from the wheelchair to the commode and back to the wheelchair, as well as examination of a nonambulatory person while that person is seated in a specially designed wheelchair latched to the commode. The specially designed, removable seat has a low profile and is reversible on the commode rim to aid in maneuvering a non-ambulatory person from a wheelchair to the commode and back and includes a downwardly-extending splash shield which serves as a guard against splashing and contaminating the commode rim during examination sequences.

BRIEF DESCRIPTION OF THE DRAWING

The invention will be better understood by reference to the accompanying drawings, wherein.

DESCRIPTION OF THE PREFERRED EMBODIMENTS

Figure 1:
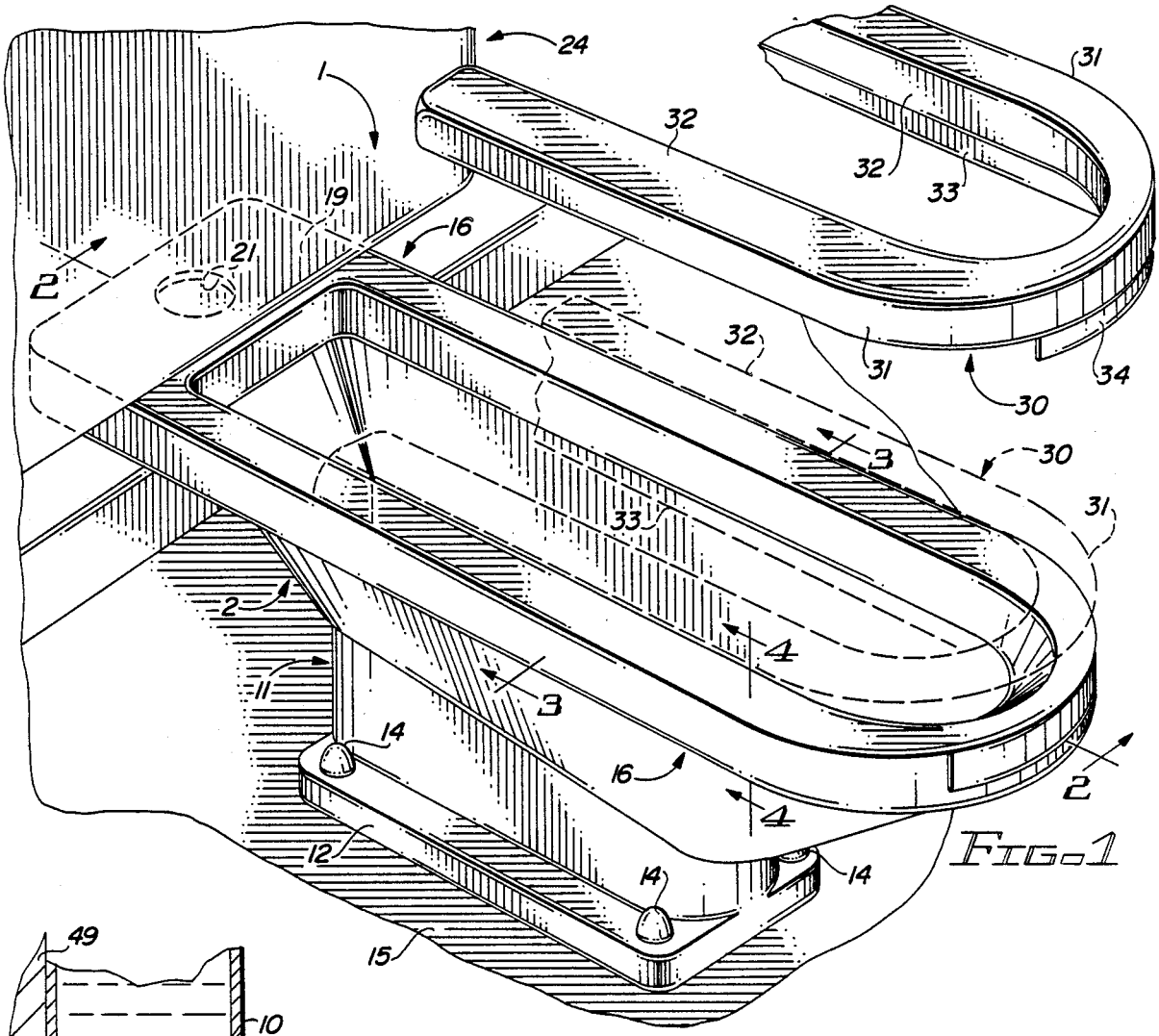
FIG. 1 is a perspective view, partially in section, of a preferred embodiment of the commode of this invention.
Figure 2:
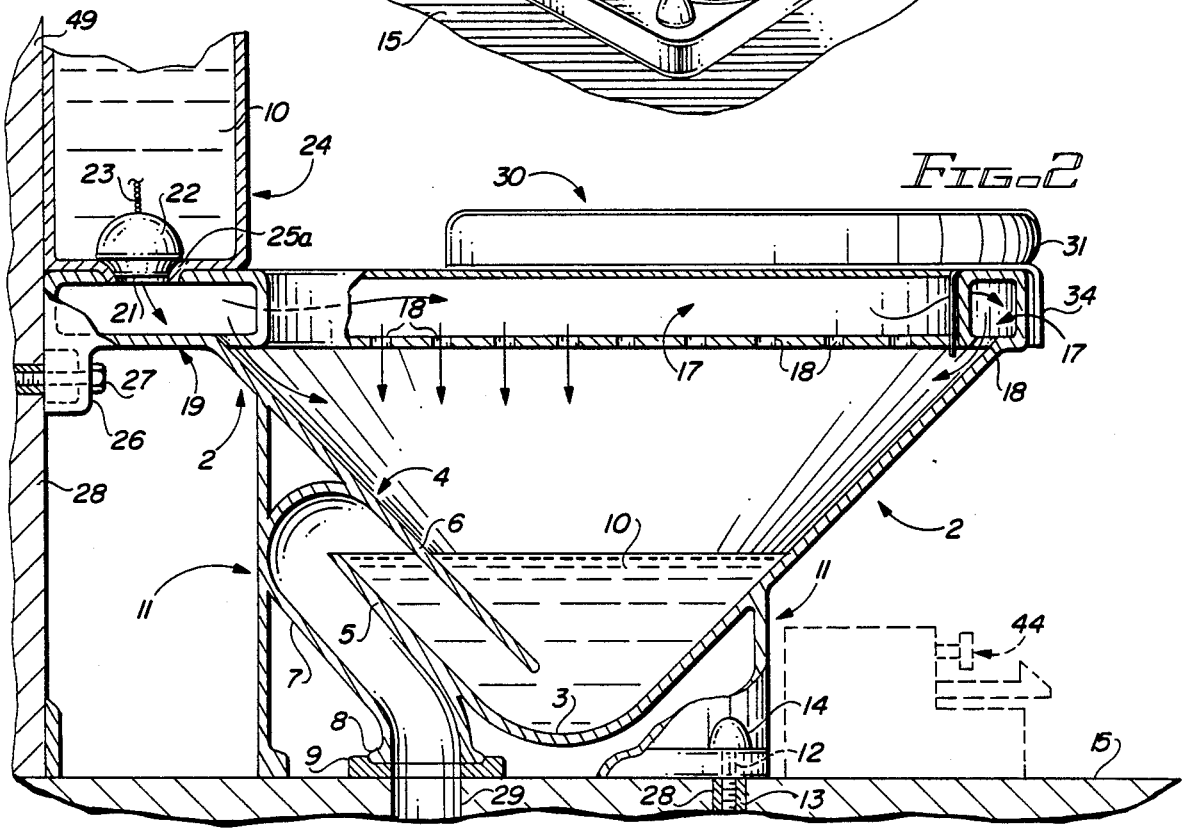
FIG. 2 is a sectional view taken along line 2—2 of the commode illustrated in FIG. 1, with a wheelchair latching mechanism illustrated in phantom.
Figure 3:
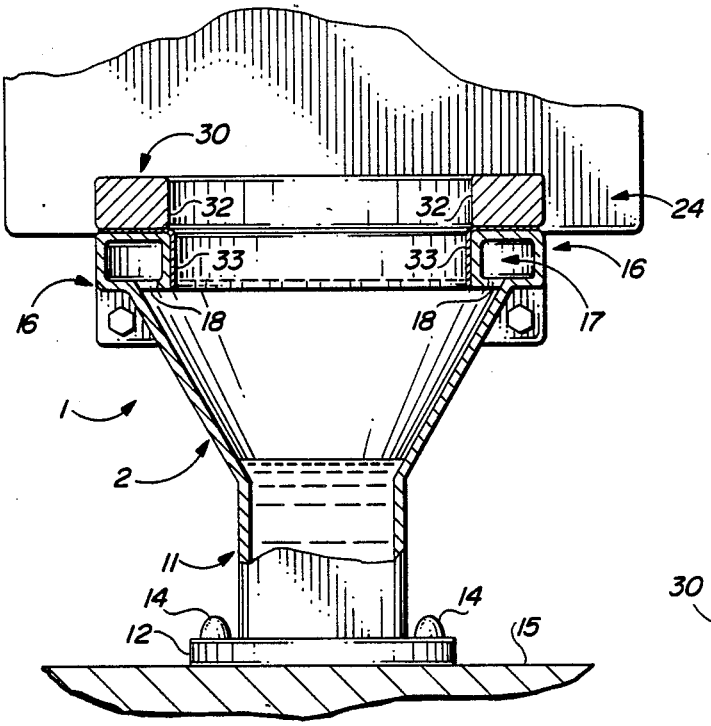
FIG. 3 is a sectional view taken along line 3—3 of the commode rim, removable seat and bowl illustrated in FIG. 1.

Referring to FIGS. 1–3 of the drawings, the commode of this invnetion is generally illustrated by reference numeral 1. The commode 1 is characterized by an elongated bowl 2, which can be fabricated of stainless steel or ceramic and tapers to define a curved bottom 3, as illustrated in FIG. 2. A bowl base 11 extends downwardly from the bowl 2 and terminates at a base flange 12, which is secured to the floor 15 by means of base flange bolts 13, that are mounted in the anchors 28, secured in the floor 15. Bolt caps 14 serve to cover the heads of the base flange bolts 13 in conventional fashion. A hollow rim 16 extends around the top perimeter of the bowl 2 and is provided with a flush chamber 19 on the rear end thereof. As illustrated in FIGS. 2 and 3, the rim 16 is hollow and the rim cavity 17 provided therein is designed to receive a quantity of water 10 which flows from the flush chamber 19 when the commode is flushed, as hereinafter described. Multiple flush openings 18 are provided in spaced relationship in the bottom portion of the rim 16, in order to channel the water 10 from the rim cavity 17 downwardly along the inside surface of the bowl 2 and cause the water supply 10 located in the bowl 2 to flush through the trap 4, as illustrated in FIG. 2. The trap 4 is characterized by a downwardly-extending top trap plate 6 which defines one side of the bowl 2, as illustrated in FIG. 2. A trap conduit 7 loops downwardly from the top trap plate 6 and defines a trap conduit flange 8 at the bottom end thereof, which trap conduit flange 8 is sealed at a sewer line 29 by means of a trap conduit seal 9. The bottom portion of the trap 4 is defined by a bottom trap plate 5, which is designed to contain the water 10 in the bowl 2 and to divert the water 10 into the trap conduit 7 when the comomde is flushed, as hereinafter described.

Figure 5:
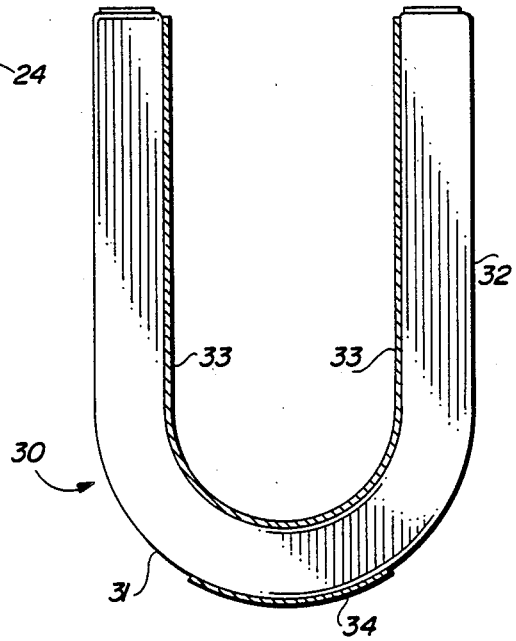
FIG. 5 is a bottom view of the removable commode seat illustrated in FIGS. 1–4.
Figure 4:
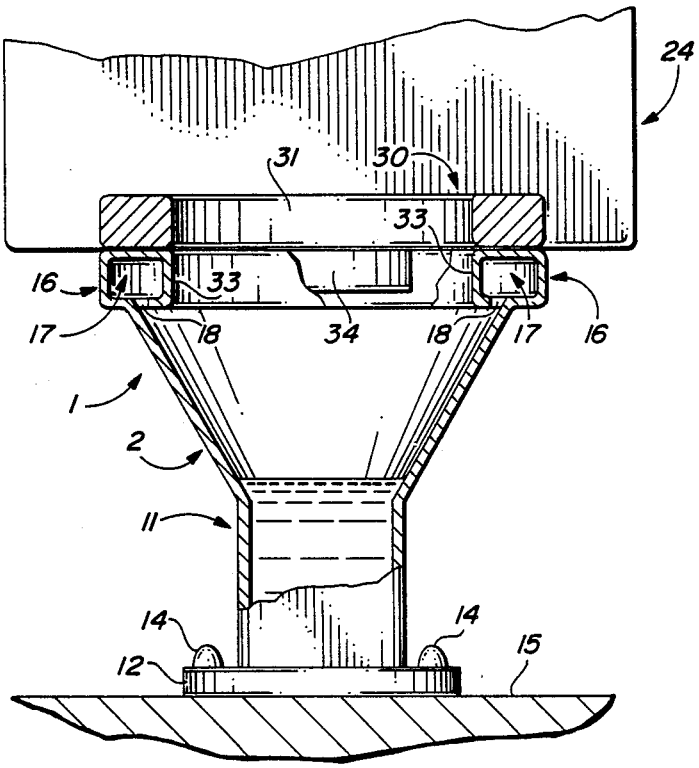
FIG. 4 is a sectional view of the commode rim, removable seat and bowl illustrated in FIG. 3, with the removable seat mounted on the rim in reverse configuration.

As further illustrated in FIGS. 1, 4 and 5, the rim 16 is designed to removably receive a U-shaped seat 30. The seat 30 is further characterized by a pair of parallel side portions 32, joined at a curved frontal portion 31. Side flanges 33 extend downwardly from the inside surfaces of the frontal portion 31 and the side portions 32 of the seat 30, for engaging the inside of the rim 16 and serve as splash plates. A front flange 34 also projects downwardly from the curved frontal portion 31 to engage the outside of the rim 16 and prevent the seat 30 from sliding rearwardly. Accordingly, it will be appreciated from a consideration of FIG. 1, that the seat 30 is easily removed from the rim 16 by simply exerting upward pressure thereon and disengaging the side flanges 33 and the front flange 34 from the rim 16.

As illustrated in FIG. 2 of the drawings, a conventional water tank 24 is mounted on the flush chamber 19 and communicates with the flush chamber 19 by means of an opening 25*a* in the tank bottom 25 and a registering valve seat 21, located in the flush chamber 19. A valve 22 normally fits in the opening 25*a* and the valve seat 21, in order to maintain a quantity of water 10 in the water tank 24. A valve chain 23 extends upwardly from the top of the valve 22 and is attached to a conventional flushing mechanism (not illustrated) for flushing the commode 1 in conventional fashion. In a most preferred embodiment of the invention, the flush chamber 19 is secured to the wall 49 by means of a bolt 27, which extends through a flush chamber bracket 26 and engages an anchor 28, provided in the wall 49.

In operation, the commode 1 is capable of being conveniently used in conventional fashion by ambulatory patients and by wheelchair-bound persons who are able to stand, as well. When the commode 1 is used by a wheelchair-bound person who is not able to stand, a wheelchair (not illustrated) is initially secured to the latching device 44, mounted to the commode 1 and illustrated in phantom in FIG. 2. This latching device 44 is described in my U.S. Pat. No. 4,729,573, entitled "Wheelchair Latching Device". The wheelchair-bound person can then maneuver from the wheelchair to the commode 1 and back, without fear of inadvertent displacement of the wheelchair from the commode 1 or shifting of the commode seat during transmit. This movement is enhanced by the low profile of the removable and reversible seat 30 and contamination of the rim 16 is prevented by the downwardly-extending, U-shaped side flanges 33. Since the seat 30 is maintained on the rim 16 only by the side flanges 33 and the single front flange 34, it is easily removed from the rim 16, discarded and replaced.

Figure 6:
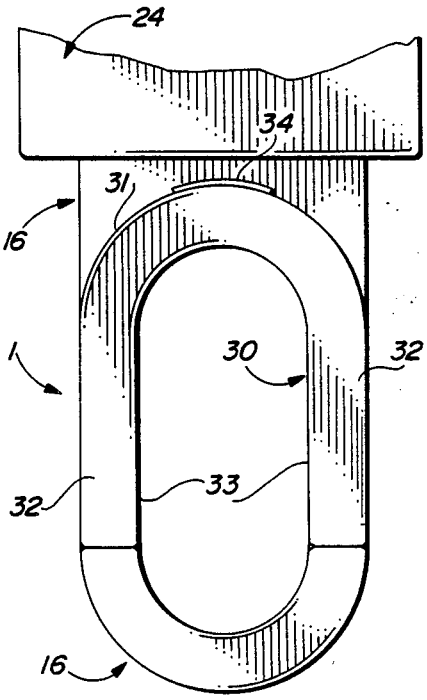
FIG. 6 is a top view of the removable commode seat mounted on the commode in reverse configuration.

Referring now to FIG. 6 of the drawings, the seat 30 may be positioned on the rim 16 of the commode 1 in reverse configuration, in order to better support a person during the performance of certain diagnostic procedure, such as a lower gastrointestinal procedure, in non-exclusive particular.

It will be appreciated by those skilled in the art that the bowl 2 and the bowl base 11 of the commode 1 can be manufactured of various materials, including stainless steel and ceramics, according to the knowledge of those skilled in the art. Furthermore, as heretofore described, the water tank 24 is conventional in design and can be mounted on the shaped flush chamber 19 as illustrated in FIG. 2, with a conventional valve 22, valve chain 23 and cooperating flush mechanism (not illustrated), also according to the knowledge of those skilled in the art. Moreover, while the seat 30 is most preferably constructed of a plastic material which is injection-molded to reduce the cost of manufacture, it is understood that the seat 30 may also be constructed of other materials, including wood and fiberglass, in non-exclusive particular. The seat 30 may further be padded by techniques known to those skilled in the art.

While the preferred embodiments of the invention have been described above, it will be recognized and understood that various other modifications may be made therein and the appended claims are intended to cover all such modifications which may fall within the spirit and scope of the invention.

Having described my invention with the particularity set forth above, what is claimed is:

1. A commode for receiving handicapped and wheelchair-bound persons, comprising a bowl mounted on a floor and having a water trap therein and a hollow, bottom-perforated rim having a generally U-shaped portion defined by parallel rim portions connected by a curved rim frontal portion bordering the top of said bowl; said U-shaped portion extending integrally from a flush chamber provided in said rim opposite said rim frontal portion of said rim; a water tank stacked on said flush chamber, a valve seat provided in said water tank and said flush chamber and a flush valve seated in said valve seat; flush apparatus provided in said water tank and connected to said flush valve, for selectively opening said flush valve and allowing water to flow from said water tank to said flush chamber and through said rim; a generally U-shaped, elongated, reversible seat defined by parallel side portions connected by a curved frontal portion and having a substantially flat top segment and a substantially flat bottom bounded by an inside wall and an outside wall and further comprising a continuous, generally U-shaped inside flange extending downwardly from the inside edge of said seat for engaging the inside surface of said rim portions and locating said flat bottom on said rim portions and a curved from flange carried by said seat and downwardly extending from said outside wall of said seat for engaging the outside surface of said curved rim frontal portion when said seat is disposed on said rim in a first configuration, said curved front flange spanning a lateral distance less than the distance between said parallel rim portions so as to be positionable against said flush chamber while projecting downwardly between said parallel rim portions when said seat is reversed on said rim in a second configuration,the length of said side portions being less than said parallel rim portions such as to allow said inside flange to extend between said parallel rim portions but not into said curved rim frontal portion when said curved front flange engages said flush chamber with said seat positioned on said rim in said second configuration.

2. The commode of claim 1, further comprising latch means mounted on the floor in front of said commode, said latch means adapted to engage and releaseably secure a wheelchair in close proximity to said commode.

* * * * *